US006742359B1

(12) United States Patent
Takessian

(10) Patent No.: US 6,742,359 B1
(45) Date of Patent: Jun. 1, 2004

(54) JEWELRY PIECE WITH A CHANGEABLE DECORATIVE ARTICLE SETTING

(76) Inventor: Korabet Takessian, 41721 Hanford Rd., Canton, MI (US) 48187

( * ) Notice: Subject to any disclaimer, the term of this patent is extended or adjusted under 35 U.S.C. 154(b) by 0 days.

(21) Appl. No.: 10/198,636

(22) Filed: Jul. 17, 2002

(51) Int. Cl.[7] ..... A44C 17/02
(52) U.S. Cl. ..... 63/29.1; 63/26
(58) Field of Search ..... 63/26, 29.1

(56) References Cited

U.S. PATENT DOCUMENTS 1,182,534 A * 5/1916 Driggott ..... 63/29.1
1,707,780 A * 4/1929 Baum ..... 63/29.1
1,712,171 A * 5/1929 Rochas ..... 63/29.1
3,568,467 A * 3/1971 Ellison ..... 63/29.1
5,375,434 A * 12/1994 Wertheimer et al. ..... 63/29.1
6,427,487 B1 * 8/2002 Morgan ..... 63/29.1
6,484,537 B2 * 11/2002 Takessian ..... 63/29.1
6,490,886 B1 * 12/2002 Steinhauer et al. ..... 63/15
2001/0045105 A1 * 11/2001 Takessian ..... 63/29.1
2003/0154740 A1 * 8/2003 Arnell ..... 63/26

* cited by examiner

*Primary Examiner*—William L. Miller
*Assistant Examiner*—Katherine Mitchell
(74) *Attorney, Agent, or Firm*—John R. Benefiel

(57) ABSTRACT

A jewelry piece has a setting including a pivoted spring element having first and second elongated resiliently bendable segments extending over an article receiving opening in the jewelry piece, a seat urged against the undersurface of the article by resilient bending deflection of the spring element when the second segment is positioned beneath a catch, to urge the article against a stop to position the article in the opening.

10 Claims, 3 Drawing Sheets

JEWELRY PIECE WITH A CHANGEABLE DECORATIVE ARTICLE SETTING

BACKGROUND OF THE INVENTION

This invention concerns jewelry and more particularly jewelry pieces having settings which allow ready changing of gems or other decorative articles such as pearls so as to change to an article of a different type, color, cut, etc.

Various changeable gem setting designs have heretofore been developed, but these have not been readily adaptable to gemstones of various shapes, or to also accommodate such other decorative articles as pearls.

Another drawback is that the setting does not accommodate different sizes of the same shape gemstones.

Some designs are complicated to use and/or are expensive to manufacture due to their complexity.

Another problem is the reflection of the color of the material used in the setting to the exposed gem faces, adversely affecting the observed color of the gem, particularly gems cut so as to not have a culet.

It is the object of the present invention to provide a gem setting capable of allowing a quick and convenient change of the gemstone or other decorative article and which accommodates a variety of shapes and variations in size of the article.

Another object is to provide such a setting which is simple to use and is uncomplicated and inexpensive, yet provides a very secure retention of the mounted article to be suitable for precious gems, and allows various types of decorative articles to be installed on a jewelry piece such as a pendant or ring.

SUMMARY OF THE INVENTION

These objects and others which will be understood upon a reading of the following specification and claims are achieved by a setting comprised of spring element pivotally connected to a portion of a jewelry piece having a seat adapted to receive a decorative article. The spring element is resiliently deflected by an article in the seat when one end of the spring element is positioned beneath a catch, urging the article against a stop. The spring element may be comprised of a first and second elongated resiliently bendable segments extending from a pivot connection in the same general direction but angled apart. A shorter segment has a generally annular article seat at its free end adapted to engage the lower end or surface of the decorative article to be held in the jewelry piece.

The other longer segment extends above the shorter segment and is adapted to be deflected to engage a catch on the jewelry piece after a gemstone or other article is pushed against a bezel or other stop surface by being engaged by the seat, urged against the same by the spring force generated by resilient deflection of the short segment.

The resilient deflection of the segments is maintained after the longer segment is moved beneath a catch. This deflection accommodates variations in size and shape of the mounted decorative article such as gemstones of various different cuts.

The spring element may also be constructed of an elongated wireform hinged at one end and having a decorative article seat intermediate its length, with the free end movable under a catch. This causes resilient bending of the muddle of the spring element to generate a spring force urging an article in the seat against a stop.

DETAILED DESCRIPTION

In the following detailed description, certain specific terminology will be employed for the sake of clarity and a particular embodiment described in accordance with the requirements of 35 USC 112, but it is to be understood that the same is not intended to be limiting and should not be so construed inasmuch as the invention is capable of taking many forms and variations within the scope of the appended claims.

Figure 1:
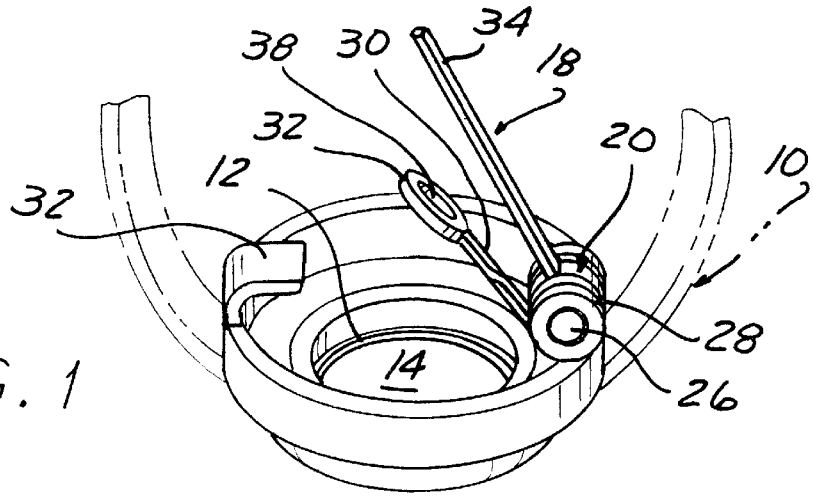
FIG. 1 is an inverted and enlarged perspective view of a replaceable decorative article setting incorporated in a ring a portion shown in fragmentary form by phantom lines.

Referring to the drawings, FIG. 1 shows a setting for reliably securing a decorative article in a jewelry piece, shown here as a ring 10.

Figure 3:
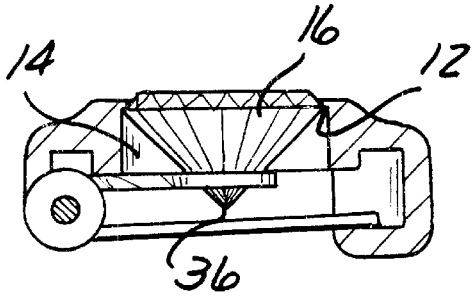
FIG. 3 is a sectional view of the setting shown in FIGS. 1 and 2 which a faceted gemstone installed therein.

An annular bezel stop surface 12 defined by a portion of the jewelry piece 10 surrounds an opening 14 sized to receive the upper portion of a decorative article such as a faceted gemstone 16 (FIG. 3) so as to partially protrude through the opening. The seat 12 engages the girdle of the article to locate the same in a partially protruding position. Other seat configurations, such as prongs (FIG. 12) could also be used.

Figure 4:
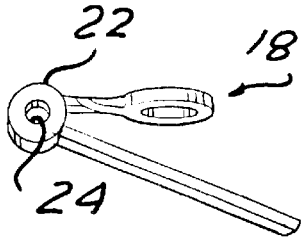
FIG. 4 is a perspective view of a setting element shown pivoted to an article seat portion in FIG. 1.

A pivoted spring element 18 has a pivot connection 20 here comprised of a disc 22 having a hole 24 (FIG. 4) receiving a pin 26 which passes through a clevis 28 fixed on the jewelry piece portion adjacent one side of the opening 14.

A first elongate segment 30 is attached to and extends radially away from the pivot connection 20 and has an annular seat 32 fixed to its outer free end. A second longer elongate segment 34 also is affixed to and extends radially away from the pivot connection 20 in the same general direction, as the first elongate segment 30 but angled up therefrom when both are swung over the opening 14 to extend across the same. The second elongate segment 34 is long enough to extend to the other side of the opening 14.

A catch 32 is affixed to the jewelry piece portion opposite the pivot connection 20, comprised of an inturned blade able to capture the free end of the second segment 34 when positioned below the catch.

The segments 30, 34 are constructed of a resiliently deflectable material such as a suitable spring metal here shaped as thin square rods. When an article is placed in the opening 14, the second segment is pushed down to engage the under surface of the article. In the case of the faceted gemstone 16 FIG. 3), the culet 36 is received in the hole 38 of the seat 32 to be securely engaged. The spring element 18 is configured such that resilient bending of segments 30, 34 occurs as the second segment 34 is depressed sufficiently to be passed beneath the catch 20, generating a spring force securely positioning the gemstone or other decorative article in position against the stop surface or surfaces 12.

Figure 8:
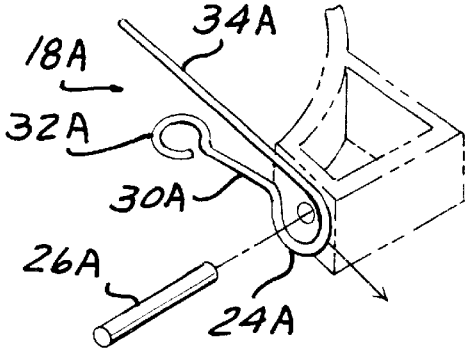
FIG. 8 is an enlarged view of a fragmentary part of the pendant of FIG. 7 shown in phantom lines, and a pivoted spring element included in the replaceable article setting.
Figure 6:
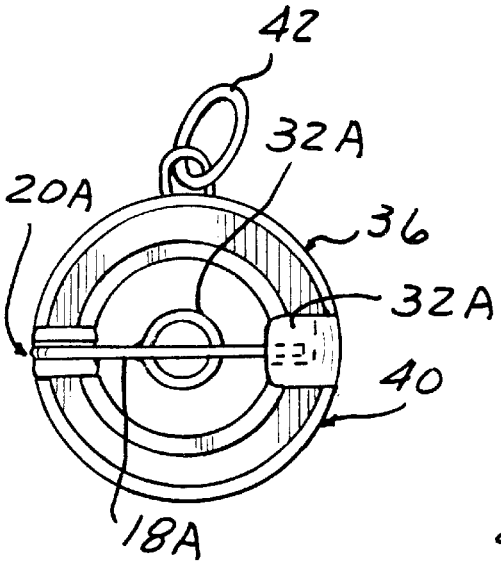
FIG. 6 is a bottom view of the pendant shown in FIG. 5, showing the details of the article setting of a slightly different form than the setting shown in FIG. 1.
Figure 5:
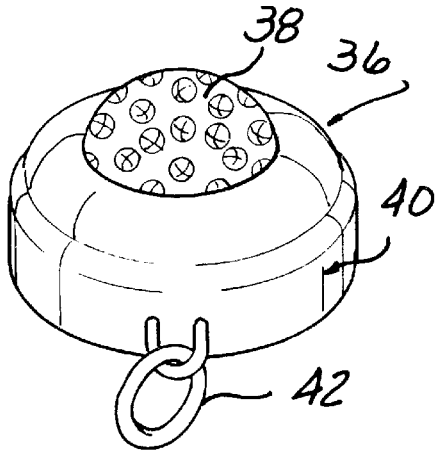
FIG. 5 is a perspective view of a pendant having a decorative article comprised of a gem encrusted metallic ball mounted therein by the setting according to the present invention.

FIGS. 5 and 6 show the setting used in a pendant 36, with a metal ball 38 encrusted with small gems used as the decorative article, protruding from an annular case 40 adapted to be hung from a chain attached to a metal loop 42. In this embodiment, the spring element 18A comprises a wire form with a loop in the first segment 30A (FIG. 8) forming the seat 32A. An intermediate partial loop 24A receives a pin 26A and connects the segments 30A, 34A to create the pivotal connection 20A.

Figure 7:
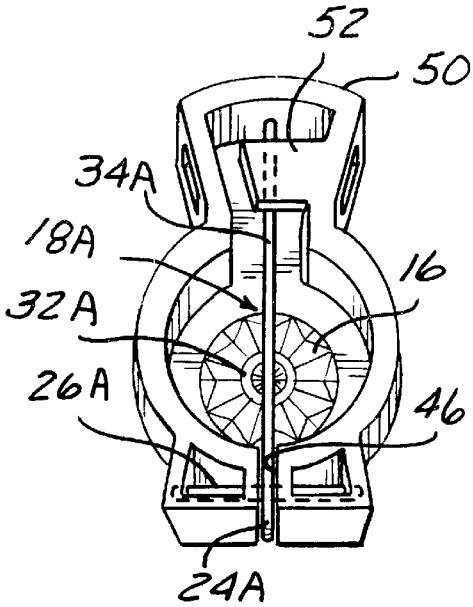
FIG. 7 shows a reverse view of a pendant of a different configuration showing details of another form of the setting according to the present invention.

FIG. 7 shows another form of pendant 44 of a keyhole shape, also using the wire form type pivoted spring element 18A.

In this embodiment a cross pin 26A passes across a slot 46 in the lower section 48 of the pendant case.

The upper section 50 has openings allowing a chain to be strung. A tab 52 acts as a catch for the free end of the second segment 34A.

Figure 9:
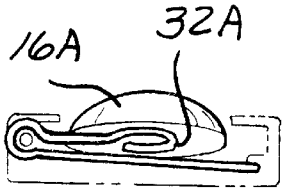
FIG. 9 is a side view of the pivoted spring element engaging a cabochon cut gemstone.
Figure 10:
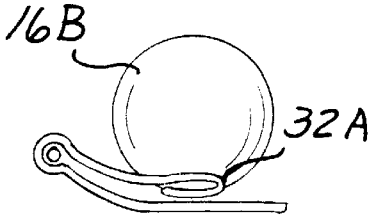
FIG. 10 is a side view of the pivoted spring element engaging a pearl.
Figure 11:
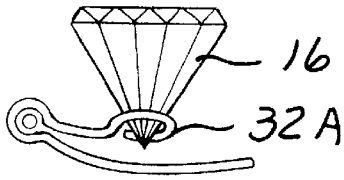
FIG. 11 is a side view of the pivoted spring element engaging a faceted gemstone.
Figure 2:
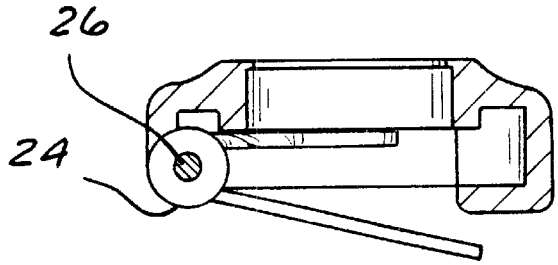
FIG. 2 is a cross sectional view of the setting shown in FIG. 1.

FIGS. 9-11 show engagement of the seat 32A with a cabochon cut stone 16A (FIG. 9), a pearl 16B (FIG. 10), and a faceted gemstone 16 (FIG. 11).

Figure 12:
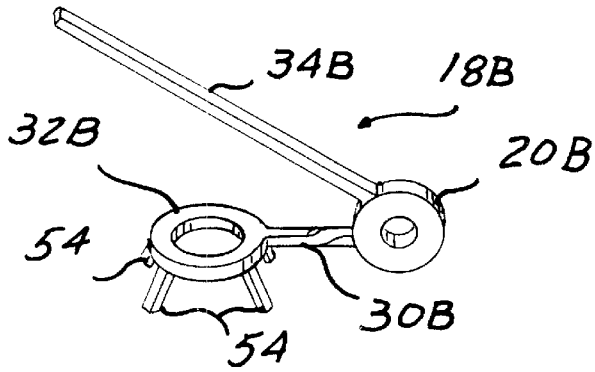
FIG. 12 is a perspective view of a spring element in which article engaging prongs are added to the seat.

FIG. 12 shows another form of spring element 18B having segments 30B, 34B in which a series of upwardly projecting prongs 54 are arranged about the perimeter of the seat 32B. A decorative article can be received within the prongs 54 to center the same.

Figure 13:
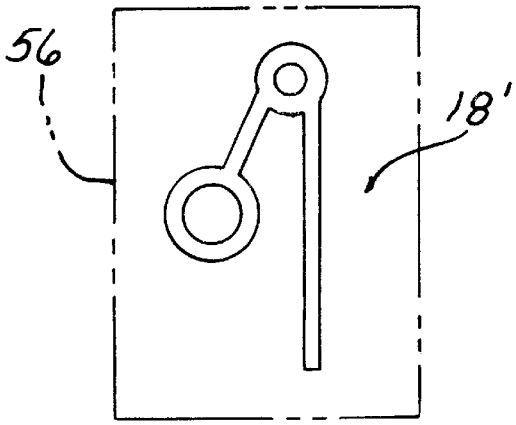
FIG. 13 is a plan view of a flat sheet from which a spring element perform is cut.
Figure 14:
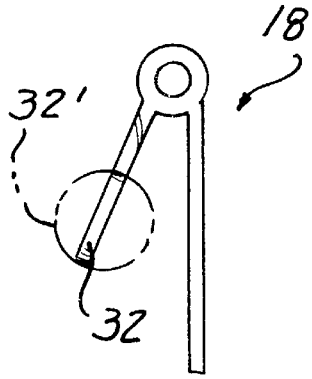
FIG. 14 is a plan view of a spring element after twisting the seat to lie at right angles to the hinge pivot.

FIGS. 13 and 14 show an advantageous low cost method for manufacturing the spring element 18.

A flat spring element perform 18' is cut from a sheet of a suitable spring metal 56.

The seat 32' is then twisted sufficiently to be permanently positioned to lie orthogonally with respect to the pivot connection 20, thus completing the spring element 18.

Figure 15:
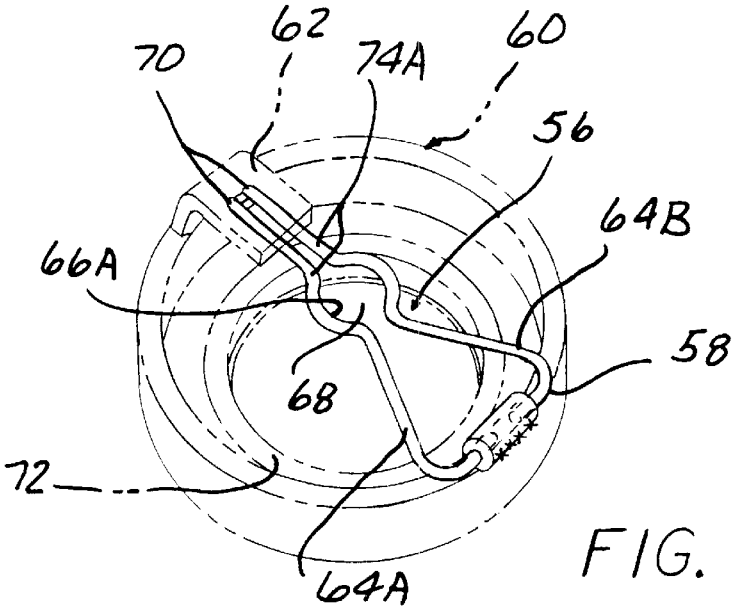
FIG. 15 is a perspective view of another embodiment of the spring element assembled to a jewelry piece shown in phantom lines.

FIG. 15 shows another embodiment of the setting in which a pair of double wireforms 64A, 64B form a spring element 56 which has a pivoted connections 58 at one end and extends straight across the back of a jewelry piece 60 to a catch 62. The other ends 70 of the other wireform segments 74A, 74B are connected together and are positionable beneath the catch 62.

An arcuate bend 66A, 66B formed in each wireform segments 64A, 64B at the same location along the length each forming half of a roughly circular seat at an intermediate point along the length of the spring element 56.

With a decorative article (not shown) in or against the seat 68, each end segment 74A, 74B of the spring element 56 is deflected when the ends 70 are moved beneath the catch 62. This creates a spring force urging the article against a bezel 72 or other stop surface of the jewelry piece 60.

Thus, a simple but reliable setting has been provided which insures secure retention of valuable gems, pearls, etc. while allowing a quick and convenient replacement thereof.

What is claimed is:

1. A jewelry piece having a replaceable setting for a decorative article comprising:

an opening in said jewelry piece configured to receive said decorative article allowing a portion thereof to protrude forwardly of said opening said jewelry piece having a stop preventing said decorative article from passing through said opening;

a pivoted spring element having a pivot connection pivotally joining said element to said jewelry piece at a point adjacent said opening, said spring element formed by two resiliently deflectable elongate segments, each extending from said pivot connection to be swingable thereabout towards and over said opening, or back and away from said opening, a first deflectable elongate segment of said spring element adjacent said pivot connection having an article engaging seat located away from said pivot connection, and a second deflectable elongate segment of said spring element having an end positionable beneath a catch on an opposite side of said opening from said pivot connection, when pivoted towards said opening carrying said seat to be in engagement with an under portion of a decorative article received into said opening and causing said first and second deflectable elongate segment of said spring element to be resiliently deflected thereby generating a resilient force acting on said decorative article to hold said decorative article against said stop;

said catch on said jewelry piece engagable with said second deflectable elongate segment of said spring element to hold said spring element in said deflected state, whereby said decorative article can be readily replaced and secured therein by manipulation of said spring element.

2. The jewelry piece according to claim 1 wherein said first segment is of a length positioning said seat at the approximate center of said opening when swung into engagement with said decorative element under portion.

3. The jewelry piece according to claim 2 wherein said seat is substantially configured in an annular shape to allow a culet of a gemstone to be received therein.

4. The jewelry piece according to claim 3 wherein said seat comprises a flat paddle having a central hole to define said annular shape.

5. The jewelry piece according to claim 1 wherein said element is a wire form and wherein said first and second deflectable elongate segments of said spring element are comprised of sections of said wire form.

6. The jewelry piece according to claim 5 wherein said spring element is constructed of metal.

7. The jewelry piece according to claim 5 wherein said sections of said wire form extend side by side and are joined together at one end and are each pivotally mounted at another end to said pivot connection, each section of said wire form having an arcuate bend at the same location along said wire sections to together to form a generally annular shape comprising said seat.

8. The jewelry piece according to claim 1 wherein said second deflectable elongate segment of said spring element extends completely across said opening and said first deflectable elongate segment of said spring element terminates in said seat adapted to engage a decorative article.

9. The jewelry piece according to claim 1 wherein said first and second deflectable elongate segments of said spring element extend from said pivot connection in generally the same direction over said opening but angularly separated, with said second deflectable elongate segment of said spring element extending at an angle but in the same direction across said opening as said first deflectable elongate segment of said spring element.

10. The jewelry piece according to claim 9 wherein said first deflectable elongate segment of said spring element is shorter than said second deflectable elongate segment of said spring element to locate said seat at the an approximate center of said opening.

* * * * *